US009352571B2

(12) United States Patent
Sasaki

(10) Patent No.: US 9,352,571 B2
(45) Date of Patent: May 31, 2016

(54) LIQUID EJECTING APPARATUS WITH A VAPOR COLLECTING UNIT

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/498,624

(22) Filed: Sep. 26, 2014

(65) Prior Publication Data

US 2015/0103117 A1 Apr. 16, 2015

(30) Foreign Application Priority Data

Oct. 11, 2013 (JP) ..... 2013-213971

(51) Int. Cl.

| | |
|---|---|
| ***B41J 2/165*** | (2006.01) |
| ***B41J 2/17*** | (2006.01) |
| ***B41J 11/00*** | (2006.01) |
| ***B41J 29/377*** | (2006.01) |
| *B41J 3/407* | (2006.01) |

(52) U.S. Cl.

CPC ..... *B41J 2/16517* (2013.01); *B41J 2/1714* (2013.01); *B41J 2/1721* (2013.01); *B41J 11/002* (2013.01); *B41J 29/377* (2013.01); *B41J 3/4078* (2013.01); *B41J 2002/16564* (2013.01)

(58) Field of Classification Search

None

See application file for complete search history.

(56) References Cited

U.S. PATENT DOCUMENTS

| | | | | |
|---|---|---|---|---|
| 6,397,488 | B1 * | 6/2002 | Brinkly | B41J 11/002 101/424.1 |
| 2001/0026696 | A1 | 10/2001 | Yokota et al. | |
| 2003/0179260 | A1 | 9/2003 | Anderson et al. | |
| 2004/0104963 | A1 | 6/2004 | Nakazawa | |
| 2004/0183879 | A1 | 9/2004 | Nakazawa | |
| 2009/0244247 | A1 | 10/2009 | Yamamoto et al. | |
| 2009/0303285 | A1 | 12/2009 | Matsuhashi | |
| 2010/0149297 | A1 | 6/2010 | Kanada | |
| 2011/0109692 | A1 | 5/2011 | Ito et al. | |
| 2011/0310172 | A1 | 12/2011 | Miyata | |

FOREIGN PATENT DOCUMENTS

| | | |
|---|---|---|
| EP | 1-464-679 | 10/2004 |
| JP | 05-330033 | 12/1993 |
| JP | 06-064159 | 3/1994 |
| JP | 11-014258 | 1/1999 |

(Continued)

OTHER PUBLICATIONS

European Search Report for Application No. 14188623.4 dated Dec. 22, 2014.

*Primary Examiner* — Bradley Thies
(74) *Attorney, Agent, or Firm* — Workman Nydegger

(57) ABSTRACT

A liquid ejecting apparatus includes a first heating unit which heats liquid ejected onto a medium for recording; a first collecting unit which is provided at a position facing a first face of the medium for recording at a portion at which a heating process is performed with respect to the liquid using the first heating unit; and a second collecting unit which is provided at a position facing a second face of the medium for recording at a portion at which the heating process is performed, in which the first collecting unit and the second collecting unit include a vapor collecting unit which collects vapor which is generated in the heating process from a vapor intake port, and a vapor liquefying unit which liquefies the collected vapor.

5 Claims, 10 Drawing Sheets

(56) References Cited

FOREIGN PATENT DOCUMENTS

| | | | | |
|---|---|---|---|---|
| JP | 2004-001426 | | | 1/2004 |
| JP | 2004-181672 | | | 7/2004 |
| JP | 2004-230709 | | | 8/2004 |
| JP | 2006-095774 | | | 4/2006 |
| JP | 2006095774 | A | * | 4/2006 |
| JP | 2008-158218 | | | 7/2008 |

* cited by examiner

LIQUID EJECTING APPARATUS WITH A VAPOR COLLECTING UNIT

The entire disclosure of Japanese Patent Application No: 2013-213971, filed Oct. 11, 2013 is expressly incorporated by reference herein in its entirety.

BACKGROUND

1. Technical Field

The present invention relates to a liquid ejecting apparatus which has a structure in which liquid is ejected onto a medium for recording, the ejected liquid is heated and dried, and generated vapor thereof is collected by being liquefied.

2. Related Art

As examples of such a liquid ejecting apparatus, there are ink jet recording apparatuses which are described in JP-A-5-330033, JP-A-11-14258, and JP-A-2004-1426.

In JP-A-5-330033, the following is described.

A shielding member is provided located on a recording face side of a medium for recording which is transported. The shielding member covers a recording head, a heater for drying ink, and the medium for recording. The shielding member prevents solvent vapor of ink (which is generated due to heating using the heater) from diffusing outside. The vapor that is generated in a space surrounded by the shielding member is collected as liquid using a heat exchanger. Evaporated solvent vapor is thus prevented from being released to a surrounding environment.

In JP-A-11-14258, the following is described.

Drying equipment is provided in the rear portion of a recording head. After being recorded upon, a medium for recording is heated in the drying equipment. Vapors generated thereby are collected on the upper part in an exterior part The vapor is condensed by being upon contact with a radiation fin. Water drops that are generated due to liquefied vapor are collected using a fan, and are guided to a waste liquid tank.

In JP-A-2004-1426, the following is described.

In an ink jet printing apparatus, a structure is described in which only vapor of oil is liquefied from a mixture of vapor of oil and water which is generated when drying ink. The oil vapor is separated, and the water vapor is released to the atmosphere without being liquefied.

However, in the collection of vapor that is described in JP-A-5-330033 and JP-A-11-14258, only the liquefied vapor that is generated on (and rises from) the recording face side of a medium for recording is intended for collection. There is no description or suggestion regarding collecting (and liquefying thereof) vapor that is generated on the rear surface side (which is the opposite side to a recording face of the medium for recording). When recording is performed on cloth, or the like, using ink, a non-negligible amount of vapor is also generated on the rear side of a medium for recording using a heating process of ink. Rather, such a problem is not taken into consideration at all.

In JP-A-2004-1426, separating vapor of water and vapor and oil has been described in detail. However, there is no specific description of a structure of the portion that collects generated vapor. Taking into consideration the configuration of a platen 305, a print carriage 310, and a vent passage 330 that are illustrated in FIG. 3, (which is a similar configuration to that of JP-A-5-330033 and JP-A-11-14258), it is natural to consider that the intent is only to collect and liquefy vapor that is generated on (and rises from) the recording face side of a medium for recording.

Not to mention, there is no description or suggestion regarding collecting (or liquefying) vapor generated on the rear surface side (which is the opposite side to a recording face of a medium for recording). In addition, when recording is performed on cloth, or the like, using ink, a non-negligible amount of vapor is generated also on the rear side. However such a problem is not taken into consideration at all.

SUMMARY

An advantage of some aspects of the invention is to provide a liquid ejecting apparatus such as an ink jet printing apparatus in which a release of vapor to a surrounding environment can be effectively reduced by respectively collecting vapor which is generated when heating and drying liquid which is ejected to a medium for recording from a recording face side, and the rear face side which is the opposite side to the recording face side of the medium for recording, and liquefying the vapor.

According to an aspect of the invention, there is provided a liquid ejecting apparatus which includes a liquid ejecting unit which ejects liquid onto a first face of a medium for recording which has the first face and a second face which is a rear face of the first face; a first heating unit which heats the liquid ejected onto the first face of the medium for recording; a first collecting unit which is provided at a position facing the first face of the medium for recording; and a second collecting unit which is provided at a position facing the second face of the medium for recording, in which the first collecting unit and the second collecting unit include a vapor collecting unit which collects vapor which is generated in a heating process of the liquid using the first heating unit, and a vapor liquefying unit which liquefies the collected vapor.

Here, "the first collecting unit provided at a position facing the first face of the medium for recording" means that, in the specification, a vapor intake port for collecting vapor which is generated in the heating process may be provided at a position facing the first face, and the entire constituent members of the first collecting unit may not be provided at a position facing the first face.

"The second collecting unit which is provided at a position facing the second face of the medium for recording" means that, in the specification, similarly, the vapor intake port for collecting vapor which is generated in the heating process may be provided at a position facing the second face, and the entire constituent members of the second collecting unit may not be provided at a position facing the second face.

According to the aspect, the first collecting unit is provided at a position facing the first face of the medium for recording at a portion at which the heating process is performed in the first heating unit, and the second collecting unit is provided at a position facing the second face of the medium for recording at a portion at which the heating process is performed, respectively. In addition, the first collecting unit and the second collecting unit include the vapor collecting unit which collects vapor which is generated in the heating process from the vapor intake port, and the vapor liquefying unit which liquefies the collected vapor.

In this manner, in a liquid ejecting apparatus such as an ink jet printing apparatus, it is possible to effectively reduce release of vapor to a surrounding environment by respectively collecting vapor which is generated when heating and drying liquid which is ejected to a medium for recording, on the liquid ejecting face side, and the rear face side which is the opposite side thereto of the medium for recording, and liquefying the vapor.

In the liquid ejecting apparatus, a support member which supports the medium for recording may be further included, and a supported face of the medium for recording using the support member may be supported by being tilted in a range of equal to or greater than 10°, and equal to or smaller than 60° with respect to a level surface.

Vapor which is generated from the medium for recording, which is tilted, due to a heating process becomes an ascending current which goes vertically upward. Accordingly, an area of a horizontal section in a region of the ascending current with respect to an area of a portion at which the heating process is performed using heating becomes small. Accordingly, it is possible to make a size of the vapor intake port which is included in the vapor collecting unit small compared to a horizontal supporting structure in which the tilting is not performed. In this manner, it is possible to perform miniaturizing.

In the liquid ejecting apparatus, the liquid may be ink containing water and a water soluble organic solvent as liquid components, and the vapor liquefying unit may be set to a temperature in which water vapor remains as water vapor as is, and another vapor is liquefied.

Here, in the specification, the "water vapor remains as water vapor as is" means that it is not necessary for all to remain as water vapor as is, and a part thereof may be liquefied by being condensed. In addition, "another vapor is liquefied" means that it is not necessary for all of the vapor to be condensed and liquefied, and a part thereof may be vapor. Even so, it is preferable to set conditions such as a temperature of the vapor liquefying unit so that water vapor and another vapor are separated using a high separating rate.

In addition, a portion at which a temperature is set under a condition that "the vapor liquefying unit is set to the temperature in which water vapor remains as water vapor as is, and another vapor is liquefied" is a portion in which vapor in a constituent member of the vapor liquefying unit is subjected to the vapor liquefying operation.

According to the aspect, when the ejected liquid is ink containing water and a water soluble organic solvent, the vapor liquefying unit causes water vapor to remain as water vapor as is, and causes another vapor to be liquefied. Accordingly, it is possible to exclude water from waste liquid which is collected by being liquefied. Since components of ink are almost water, it is necessary to make a capacity of a waste liquid tank large since the waste liquid tank becomes full in a short time when water vapor is also included in waste liquid by being liquefied. However, according to the aspect, since water which does not deteriorate a surrounding environment is released into the environment as water vapor as is, it is possible to remarkably reduce a generation amount of waste liquid, and for this reason, it is possible to make the waste liquid tank small.

In the liquid ejecting apparatus, the liquid may be ink which contains water and a water soluble organic solvent as liquid components, and a temperature of the vapor liquefying unit may be set to a range of 40° C. to 65° C.

Here, a portion at which a temperature is set under the condition that "the temperature of the vapor liquefying unit may be set to a range of 40° C. to 65° C." is a portion at which vapor in a constituent member of the vapor liquefying unit is liquefied.

According to the aspect, when the ejected liquid is ink containing water and a water soluble organic solvent, the temperature of the vapor liquefying unit is set to a range of 40° C. to 65° C. In this temperature range, vapor of the water soluble organic solvent which is contained in the ink as a dispersing agent is liquefied, however, water vapor remains as vapor without being liquefied. Accordingly, it is possible to exclude water from waste liquid which is collected by being liquefied. Since components of ink are almost water, it is necessary to make the capacity of a waste liquid tank large, since the waste liquid tank becomes full in a short time when water vapor is also included in the waste liquid by being liquefied. However, according to the aspect, since water which does not deteriorate a surrounding environment is released into the environment as water vapor as is, it is possible to remarkably reduce a generation amount of waste liquid while suppressing releasing of an organic solvent into the surrounding environment, and for this reason, it is possible to make the waste liquid tank small.

In the liquid ejecting apparatus, the vapor liquefying unit may include a second heating unit, and a heating temperature through use of the second heating unit may be adjustable.

According to the aspect, since the heating temperature through use of the second heating unit can be adjusted, a change to an appropriate temperature for liquefying vapor of the liquid of the vapor liquefying unit becomes easy in response to a difference in a type of liquid.

Alternatively, when the liquid is the ink, a change to an appropriate temperature for making vapor of water remain as water vapor as is, and liquefying vapor of the water soluble organic solvent becomes easy.

In the liquid ejecting apparatus, the first collecting unit and the second collecting unit may include vapor intake ports for taking vapor in, and a vapor moving force generation unit which generates a force for moving vapor into the vapor collecting unit may be included in the vapor intake port, and the vapor liquefying unit may be located on a movement path of vapor which moves due to the moving force.

According to the aspect, since a moving force for moving vapor into the vapor collecting unit is generated in the vapor intake port of the vapor collecting unit due to the vapor moving force generation unit, vapor which is generated in the heating process is guided to the vapor intake port, and it is possible to easily collect the vapor in the vapor collecting unit.

In addition, since the vapor liquefying unit is located on a movement path of vapor which moves due to the moving force, it is possible to efficiently liquefy the collected vapor.

In the liquid ejecting apparatus, the vapor moving force generation unit may be a fan which generates a suction force in the vapor intake port, and causes a moving state of vapor, and the vapor liquefying unit may be located on a downstream side of the vapor intake port, and on an upstream side of the fan on a movement path of the vapor.

According to the aspect, since the vapor liquefying unit is located on the downstream side of the vapor intake port, and the upstream side of the fan on the movement path of the vapor, it is possible to reduce a concern that vapor may be condensed at a portion of the fan, in addition to the above described operational effect.

In the liquid ejecting apparatus, the vapor moving force generation unit may be provided at a position different from the movement path of the vapor, may be a fan which causes a moving state of vapor by generating a suction force in the vapor intake port using an air current, and the vapor liquefying unit may be located on a downstream side of the fan in a direction of an air current which is generated by the fan, and on a downstream side of the vapor intake port on a movement path of the vapor.

According to the aspect, it is possible to cause a moving state of vapor by generating a suction force in the vapor intake port also using a structure in which a fan which forms the vapor moving force generation unit is provided at a position different from the movement path of the vapor. In addition, it is also possible to reduce a concern that vapor may be condensed at a portion of the fan using the structure.

In the liquid ejecting apparatus, a support member which supports the medium for recording may be further included, the vapor intake port may be a communication hole which allows communication between an upper face and a lower face, which is provided in the support member, and vapor which is generated on a second face of the medium for recording may move toward the vapor liquefying unit through the communication hole.

According to the aspect, a second collection unit is located on the side below the medium for recording. In addition, the second collecting unit can collect vapor which is generated on the rear surface side which is the opposite side to the liquid ejected surface side of the medium for recording in the vapor collecting unit by having the communication hole as the vapor intake port, in a state in which the medium for recording is supported by the support member from the lower side.

In the liquid ejecting apparatus, a support member which supports the medium for recording may be further included, and a vapor moving force generation unit which generates a moving force for moving vapor into the vapor collecting unit may be further included in the vapor intake port, in which the vapor intake port may be a communication hole which allows communication between the upper face and the lower face, which is provided in the support member, the vapor liquefying unit may be configured of a material with higher thermal conductivity than that of the support member, and a moving force of the vapor using the vapor moving force generation unit may be generated when the vapor is easily condensed on a side of the vapor liquefying unit of which a thermal conductivity is higher than that of the support member.

According to the aspect, the vapor moving force generation unit can generate a moving force of vapor in the vapor intake port using a difference in thermal conductivity between the support member and the vapor liquefying unit without using a fan. It is also possible to obtain the same operational effect as that which is described above using the structure.

In the liquid ejecting apparatus, the vapor intake port of the first collecting unit may be provided at a position at which vapor which evaporates due to the heating process rises.

According to the aspect, the first collecting unit is located on the upper side above the medium for recording. In addition, the first collecting unit can effectively collect vapor which is generated on the liquid ejected surface side of the medium for recording in the vapor collecting unit from the vapor intake port which is provided at a position at which the vapor rises.

In the liquid ejecting apparatus, the first collecting unit may take ambient air into the vapor collecting unit.

According to the aspect, since it is possible to take ambient air into the vapor collecting unit in the first collecting unit, it is possible to simply adjust a temperature in the vapor liquefying unit by adjusting an amount of the ambient air which is taken in.

In the liquid ejecting apparatus, the vapor liquefying unit of the first collecting unit may be configured of a plurality of layers, and a liquefying temperature in each layer may be different.

According to the aspect, since the vapor liquefying unit is configured of a plurality of layers, and a liquefying temperature is different in each layer, it is possible to improve a liquefying efficiency of vapor using a structure of the plurality of layers.

In the liquid ejecting apparatus, a third collecting unit with respect to vapor which is generated from a region in which liquid is ejected from the liquid ejecting unit may be further included, and the third collecting unit may include a vapor collecting unit which collects the vapor, and a vapor liquefying unit which liquefies the collected vapor.

According to the aspect, since the third collecting unit collects vapor which is generated from a region in which liquid is ejected from the liquid ejecting unit, and liquefies the vapor, it is possible to further effectively reduce release of vapor into a surrounding environment.

In the liquid ejecting apparatus, vapor which is collected in the vapor collecting unit of the third collecting unit may be sent to the first collecting unit.

According to the aspect, since it is possible to cause the vapor liquefying unit of the first collecting unit to also take a role of the vapor liquefying unit of the third collecting unit, it is not necessary to provide an exclusive vapor liquefying unit for the third collecting unit, and for this reason, it is possible to realize a reduction in number of components and miniaturizing of the apparatus.

In the liquid ejecting apparatus, the first heating unit may include an electromagnetic wave irradiation unit which dries liquid using electromagnetic waves.

According to the aspect, since liquid ejected onto a medium for recording is dried using electromagnetic waves such as infrared light, a structure at a portion at which a heating process is performed is not complicated.

In the liquid ejecting apparatus, at least one of the first collecting unit and the second collecting unit may include a concentration sensor which measures an amount of vapor in air after performing vapor liquefaction.

According to the aspect, it is possible to secure a state in which vapor or an organic solvent is hardly present in air by setting a temperature of the vapor liquefying unit using a measurement result of the concentration sensor.

In the liquid ejecting apparatus, a pressure sensor which measures a vapor pressure may be included in the vapor liquefying unit of at least one of the first collecting unit and the second collecting unit.

According to the aspect, it is possible to easily make a state in which vapor or an organic solvent are not present in air by setting a temperature of the vapor liquefying unit using a measurement result of the pressure sensor.

In the liquid ejecting apparatus, a reservoir which retains liquid which is ejected for maintenance of the liquid ejecting unit may be further included, and the reservoir may also function as a reservoir of waste liquid of which vapor is liquefied in the vapor liquefying unit.

According to the aspect, since the reservoir which retains liquid which is ejected for maintenance of the liquid ejecting unit also functions as the reservoir of waste liquid of which vapor is liquefied in the vapor liquefying unit, it is possible to realize a reduction in number of components and miniaturizing of the apparatus.

In the liquid ejecting apparatus, cloth may be used as the medium for recording.

Here, "cloth" means textile goods such as cotton, linen, silk, polyester, or cloth or fabrics in which a mixture of these is used as raw yarn, and for example, there are textile goods such as broadcloth, or sheeting which is used as a material of clothing such as a blouse, a shirt, or work clothes.

According to the aspect, it is possible to use cloth as the medium for recording. In such a medium for recording, it is easy for the vapor to pass through the side opposite to a liquid ejected face of the medium for recording. The invention is particularly effective in a liquid ejecting apparatus in which such a medium for recording can be used.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIGS. 1 to 3C

Figure 1:
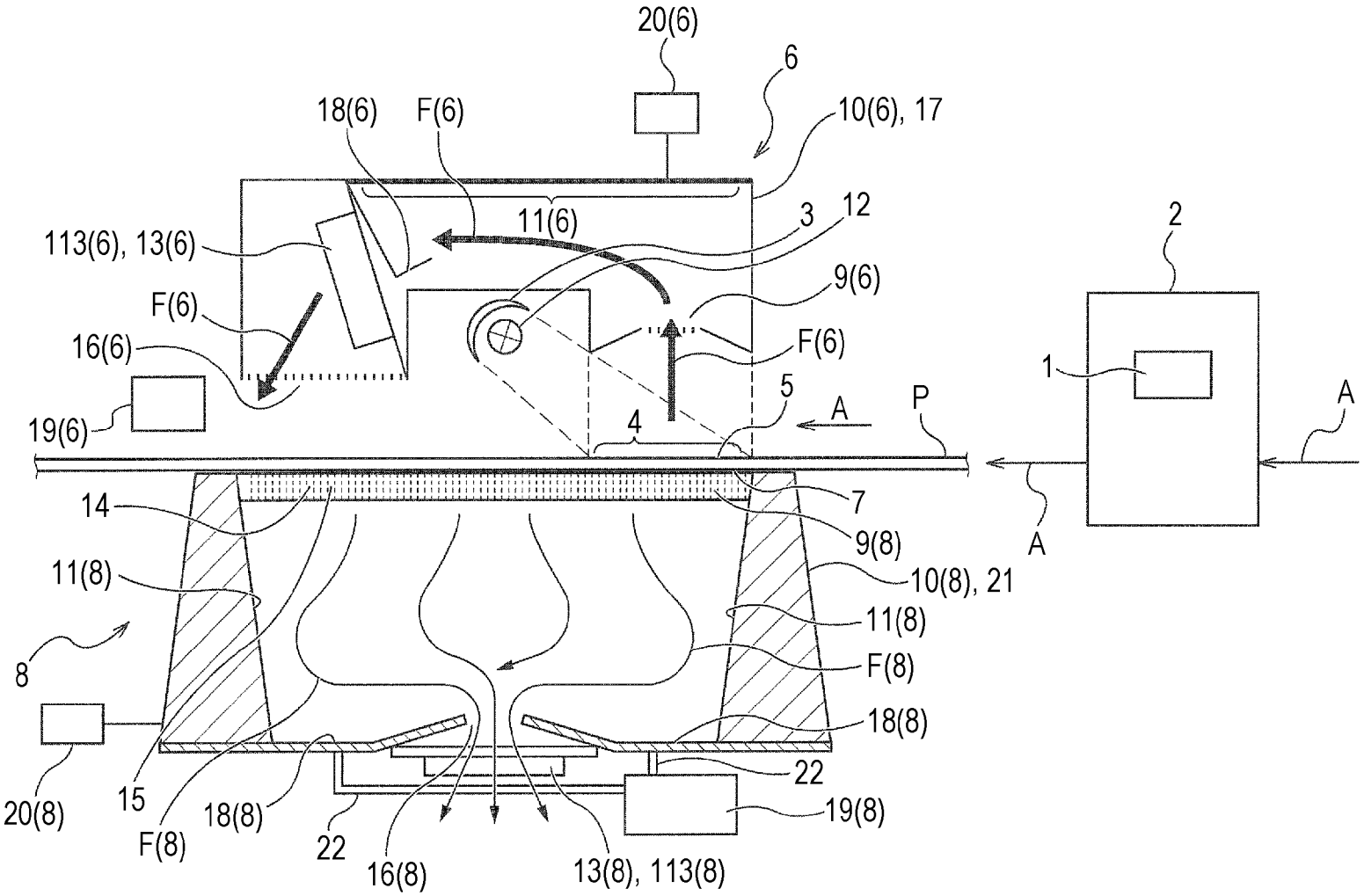
FIG. 1 is a schematic cross-sectional side view which illustrates a part of a liquid ejecting apparatus according to a first embodiment of the invention.

Hereinafter, a liquid ejecting apparatus according to a first embodiment of the invention will be described in detail with reference to FIGS. 1 to 3C. Here, a case will be described in which the liquid ejecting apparatus is an ink jet printing apparatus. However, as a matter of course, there is no limitation to this.

The liquid ejecting apparatus according to the first embodiment includes a recording execution unit 2 that includes a recording head 1 (which is a liquid ejecting unit) that ejects ink as liquid on a medium for recording P (which is a transported medium for recording). The liquid ejecting apparatus further includes a first heating unit 3 that heats ink that is discharged, that is, ink that is ejected onto the transported medium for recording P. The liquid ejecting apparatus also includes a first collecting unit 6 that is provided at a position facing a first face 5 of the medium for recording P at a portion 4 at which a heating process with respect to the ink is performed using the first heating unit 3. The liquid ejecting apparatus also includes a second collecting unit 8 that is provided at a position facing a second face 7 of the medium for recording P at the portion 4 at which the heating process is performed. In addition, the first collecting unit 6 and the second collecting unit 8 include respective vapor collecting units 10(6) and 10(8) which collect vapor generated in the heating process from respective vapor intake ports 9(6) and 9(8). The first collecting unit 6 and the second collecting unit 8 further include respective vapor liquefying units 11(6) and 11(8) that liquefy the collected vapor.

According to the embodiment, hereinafter, descriptions will be made with reference to the first face 5 being a recording face 5 (the same reference numeral 5 as for "first face" is used) which is a face onto which ink is ejected, and with reference to the second face 7 being the rear surface 7 on the opposite side to the recording face 5 (the same reference numeral 7 as for "second face" is used).

The first collecting unit 6 is located on the upper side of the second collecting unit 8. That is, the first collecting unit 6 is provided at a position facing the recording face 5 of the medium for recording P. In addition, the vapor intake port 9(6) is provided at a position at which rises vapor that evaporates due to the heating process.

Here, "provided at a position at which rises vapor that evaporates" means that the position is not limited to a position directly above the portion 4 at which the heating process is performed, and may be a position at which rising vapor can be suctioned even though the position is deviated to some extent.

In addition, the first collecting unit 6 includes a vapor moving force generation unit 13(6) which generates a moving force for moving vapor into the vapor collecting unit 10(6) in the vapor intake port 9(6). Furthermore, the vapor liquefying unit 11(6) is located on a movement path F(6) of vapor which moves due to a moving force.

According to the embodiment, the vapor moving force generation unit 13(6) is a fan 113(6) which causes a movement state of vapor by generating a suction force in the vapor intake port 9(6). Furthermore, according to the embodiment, and the vapor liquefying unit 11(6) is located at a position downstream of the vapor intake port 9(6) and on the upstream of the fan 113(6) on the movement path F(6) of vapor.

The second collecting unit 8 is located below the first collecting unit 6. That is, the second collecting unit 8 is provided at a position facing the rear surface 7 on the opposite side to the recording face 5 of the medium for recording P.

In addition, the second collecting unit 8 includes a support member 14 which supports from below the medium for recording P that is transported. A vapor intake port 9(8) is a communication hole 15 that allows communication between the upper face and the lower face of the support member 14. The vapor intake port 9(8) is configured so that vapor that is generated on the rear surface 7 side of the medium for recording P moves toward a vapor liquefying unit 11(8) through the communication hole 15.

In addition, the second collecting unit 8 includes a vapor moving force generation unit 13(8) which generates a moving force for moving vapor into the vapor collecting unit 10(8) in a vapor intake port 9(8). The vapor liquefying unit 11(8) is located on a movement path F(8) of vapor which moves due to the moving force.

According to the embodiment, the vapor moving force generation unit 13(8) is a fan 113(8) which causes a moving state of vapor by generating suction force in the vapor intake port 9(8). Furthermore, according to the embodiment, the liquefying unit 11(8) is located at a position on the downstream of the vapor intake port 9(8) and on the upstream of the fan 113(8) on the movement path F(8) of vapor.

The vapor collecting unit 10(6) of the first collecting unit 6 is composed of a cylindrical body 17 which includes the vapor intake port 9(6) and an outlet 16 (6). The inside of the cylindrical body 17 becomes the movement path F(6) of vapor. The vapor liquefying unit 11(6) is provided at a part of the inner face of the cylindrical body 17. Liquid that is liquefied in the vapor liquefying unit 11(6) is collected in a tub portion 18(6), and flows down to a waste liquid reservoir 19(6) through a flow path (not illustrated).

In the embodiment, the vapor liquefying unit 11(6) is composed of a plate material that is made of stainless steel, aluminum, or the like, and includes a second heating unit 20(6) that can adjust a temperature of the vapor liquefying unit 11(6). As a matter of course, the unit may have a structure in which liquefaction of vapor is performed using a property (thermal conductivity, or the like) of a material to be used, without including the second heating unit 20(6). In such a case, the unit may be easily manufactured using an aluminum material.

The vapor collecting unit 10(8) of the second collecting unit 8 is configured of a box-shaped body 21 that includes the vapor intake port 9(8) (which is formed of the communication hole 15 provided on the support member 14) and the outlet 16(8) (which is provided at a position directly in front of the fan 113(8) The inside of the box-shaped body 21 becomes the movement path F(8) of vapor. The vapor liquefying unit 11(8) is provided at the side surface of the box-shaped body 21. Liquid that is liquefied in the vapor liquefying unit 11(8) is collected in a tub portion 18(8), and flows down to the waste liquid reservoir 19(8) through the flow path 22.

In the embodiment, the vapor liquefying unit 11(8) is composed of a plate material that is made of stainless steel, aluminum, or the like, and includes a second heating unit 20(8) that can adjust a temperature of the vapor liquefying unit 11(8). As a matter of course, the unit may have a structure in which liquefaction of vapor is performed using a property (thermal conductivity, or the like) of a material to be used, without including the second heating unit 20(8). In such a case the unit may be easily manufactured using an aluminum material.

Any kind of the first heating units 3 can be applied to heat the medium for recording P. However, according to the embodiment, the unit may be configured by including an electromagnetic wave irradiation unit 12 which dries liquid using electromagnetic waves. As the electromagnetic waves, it is preferable to use infrared light, and wavelengths thereof are 0.76 μm to 1000 μm. In general, infrared light is further classified into near infrared light, medium infrared light, and far infrared light by wavelength, and definitions of the classification are varied. However, approximate wavelength regions are 0.78 μm to 2.5 μm, 2.5 μm to 4.0 μm, and 4.0 μm to 1000 μm.

The portion 4 (at which the heating process of the medium for recording P is performed using electromagnetic wave irradiation using the electromagnetic wave irradiation unit 12) is heated to approximately 100° C. to 120° C. The heating process is performed with respect to the ink ejected onto the medium for recording P.

The ink jet printing apparatus according to the embodiment can be applied to a medium which is formed of a material with air permeability, and a material through which vapor passes as the medium for recording P. For example, it is also possible to perform recording on cloth other than a paper sheet.

Here, "cloth" means textile goods such as cotton, linen, silk, or cloth or fabrics in which a mixture of these is used as raw yarn. For example, there are textile goods such as broadcloth, or sheeting that is used as a material of clothing such as a blouse, a shirt, or work clothes. In addition, the cloth may be synthetic fibers such as rayon, cupra, polynosic, acetate, triacetate, promix, nylon, polyester, acryl, polyvinyl chloride, and polyurethane. It is possible to use a surface-coated material such as coated paper, a rear surface exfoliation film, rayon, synthetic paper, or the like.

When the medium for recording P is cloth, vapor easily goes through the rear surface 7 side which is opposite to the recording face 5 of the medium for recording P. For this reason, vapor is also generated on the rear surface 7 side. When the medium for recording P is paper sheet, a generation of vapor on the rear surface 7 side is small. However, vapor is also generated on the rear surface 7 side depending on a type of sheet (when fiber density is low).

According to the embodiment, vapor which is generated on the rear surface 7 side of the medium for recording P is also collected using the second collecting unit in the above configuration.

According to the embodiment, as illustrated in FIG. 1, the structure in which the entirety of the first collecting unit 6 is provided at a position facing the first face 5 of the medium for recording P has been described. However, the structure is not limited to this. In the invention, the vapor intake port 9(6) for collecting vapor that is generated in the heating process may be provided at the position facing the first face 5, and the entirety of the first collecting unit 6 may not be entirely provided at the position facing the first face 5.

Similarly, the structure in which the entirety of the second collecting unit 8 is provided at a position facing the second face 7 of the medium for recording P has been described. However, the structure is not limited to this. In the invention, the vapor intake port 9(8) for collecting vapor that is generated in the heating process may be provided at the position facing the second face 7, and the entirety of the second collecting unit 8 may not be entirely provided at the position facing the second face 7.

The shape, or the like, of the communication hole 15 is not particularly limited, and all of a circular shape, a polygon, and a structure which allows vapor to pass through, other than that may be used.

Figure 2:
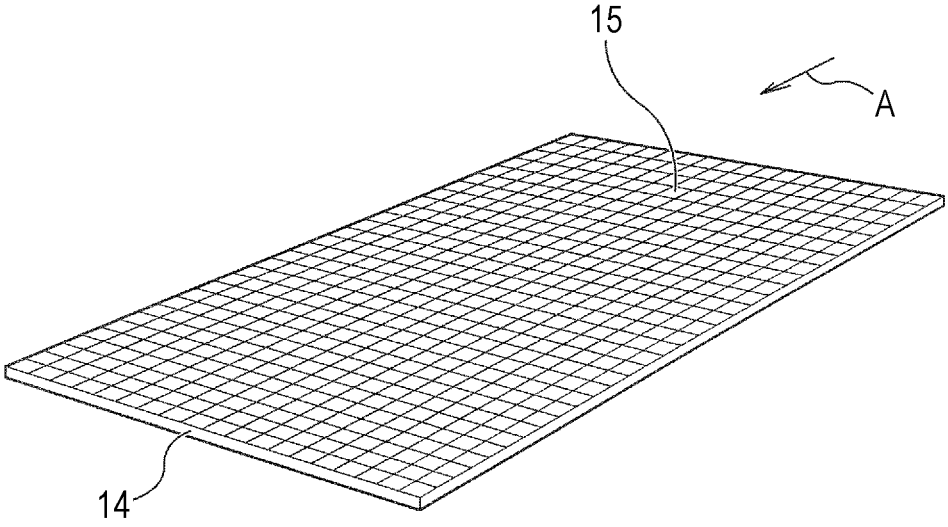
FIG. 2 is a schematic perspective view which illustrates a support member of a medium for recording in the liquid ejecting apparatus according to the first embodiment of the invention.

As illustrated in FIG. 2, as a preferable configuration example of the communication hole 15, there is a rectangle in which at least line-shaped members (parts of which having dimensions equal to or smaller than 0.3 mm) are aligned in a lattice shape. When considering condensation of vapor, a region of a fixed area is necessary for condensation. However, it is possible to make an area other than the communication hole 15 small by configuring the communication hole 15 using at least line-shaped members, parts of which having dimensions equal to or smaller than 0.3 mm. In this manner, it is possible to highly precisely suppress condensing of vapor at a contact portion with the medium for recording P in the support member 14.

In addition, it is preferable to set an aperture ratio of the communication hole 15 with respect to the support member 14 to be equal to or greater than 40%. The reason for doing so is to make vapor easily move through the communication hole 15.

According to the embodiment, the liquid that is ejected from the recording head 1 is ink containing water and a water soluble organic solvent as liquid components. As a matter of course, there is no limitation to such ink.

Figure 3A:
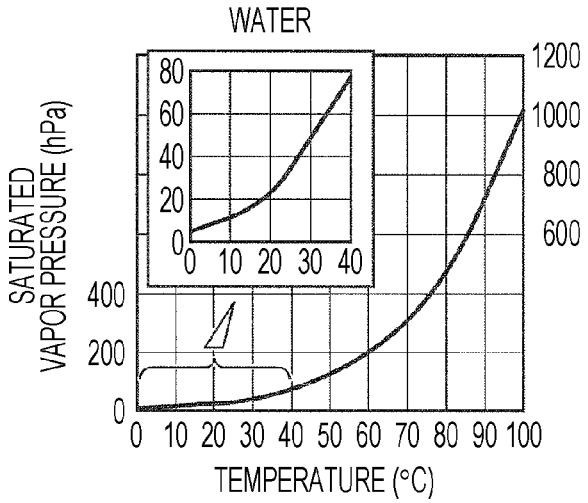
FIGS. 3A to 3C are diagrams which illustrate a relationship between a temperature and a vapor pressure in water, 2-pyrrolidone (2P), and dipropylene glycol which are components of ink.
Figure 3B:
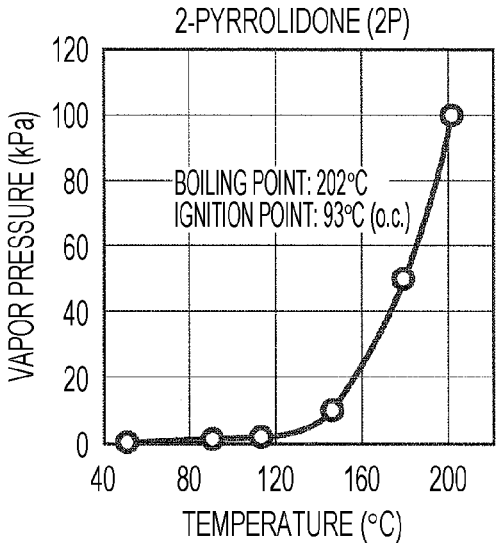
Figure 3C:
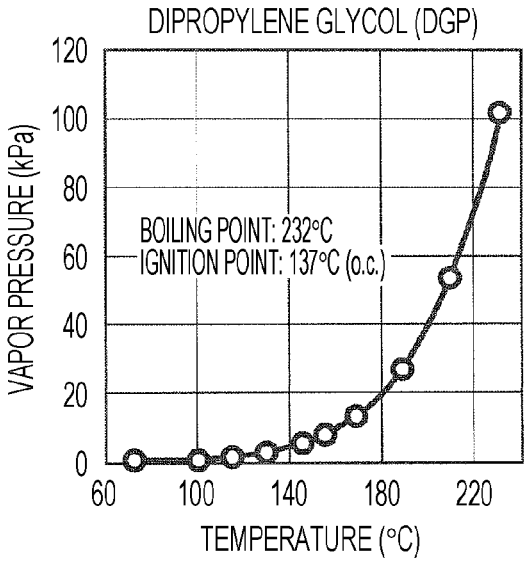

In addition, temperatures in the vapor liquefying units 11(6) and 11(8) are set so that vapor of water remains as water vapor, and another vapor is liquefied. According to the embodiment, the temperatures in the vapor liquefying units 11(6) and 11(8) are set to a range of 40° C. to 65° C. based on a relationship between temperatures of water, 2-pyrrolidone (2P), and dipropylene glycol (which are components of ink) and a vapor pressure which is illustrated in FIGS. 3A to 3C. That is, the temperature is set so that a water soluble organic solvent is liquefied and separated from vapor, and water is released to an environment as water vapor. In addition, a portion in which a temperature is set to the range of 40° C. to 65° C. is a portion in which an operation of liquefying vapor in constituent members of the vapor liquefying unit 11(6) and 11(8) is performed.

In addition, a temperature which is lower than the temperature of 40° C. to 65° C. may be set so that both water vapor and another vapor are liquefied.

Subsequently, operations of the first embodiment will be described.

According to the embodiment, the first collecting unit 6 is provided at a position facing the first face 5 of the medium for recording P in the portion 4 at which the heating process is performed using the first heating unit 3. Furthermore, the second collecting unit 8 is provided at a position facing the second face 7 of the medium for recording P in the portion 4 at which the heating process is performed. In addition, the first collecting unit 6 and the second collecting unit 8 include respective vapor collecting units 10(6) and 10(8) which collect vapor generated in the heating process from the respective vapor intake ports 9(6) and 9(8), and include respective vapor liquefying units 11(6) and 11(8) which liquefy the collected vapor.

In this manner, since vapor that is generated when heating and drying ink (ejected onto the medium for recording P in a liquid ejecting apparatus such as an ink jet printing apparatus) is respectively collected and liquefied on the recording face 5 side of the medium for recording P, and on the rear surface 7 side which is the opposite side, it is possible to effectively reduce releasing of vapor into a surrounding environment.

In addition, according to the embodiment, the ejected liquid is ink containing water and a water soluble organic solvent, the vapor liquefying units 11(6) and 11(8) cause vapor of water to remain as water vapor, and cause another vapor to be liquefied. Accordingly, it is possible to eliminate water from waste liquid that is collected by being liquefied. Since most components of ink are water-based, and the waste liquid tank becomes full in a short time when water vapor is also included in the waste liquid by being liquefied, it is necessary to make capacities of the waste liquid reservoirs 19(6) and 19(8) large.

However, according to the embodiment, since water (which does not deteriorate a surrounding environment) is released into the environment as water vapor, it is possible to remarkably reduce a generation amount of waste liquid while suppressing releasing of an organic solvent, and for this reason, it is possible to make the waste liquid reservoirs 19(6) and 19(8) small.

In addition, according to the embodiment, the temperatures of the vapor liquefying units 11(6) and 11(8) are set to the range of 40° C. to 65° C. In this temperature range, vapor of the water soluble organic solvent contained in ink as a dispersing agent is liquefied, but water vapor remains as vapor. Accordingly, it is possible to eliminate water from waste liquid which is collected by being liquefied. According to the embodiment, since water (which does not deteriorate a surrounding environment) is released into the environment as water vapor, it is possible to remarkably reduce an amount of generated waste liquid, and for this reason, it is possible to make the waste liquid reservoir small.

In addition, according to the embodiment, since it is possible to adjust heating temperatures using the second heating units 20(6) and 20(8), temperatures of the vapor liquefying units 11(6) and 11(8) can be easily changed to appropriate temperatures for liquefying vapor of the liquid corresponding to differences in types of liquid.

That is, when the liquid is ink containing water and a water soluble organic solvent, it is easy to change to an appropriate temperature for causing vapor of water to remain as water vapor as is, and for liquefying vapor of the water soluble organic solvent. Alternatively, also in a case in which both the water vapor and water soluble organic solvent are liquefied, it is easy to change to the appropriate temperature.

In addition, according to the embodiment, since a moving force for moving vapor into the vapor collecting units 10(6) and 10(8) is generated in the vapor intake ports 9(6) and 9(8) of the vapor collecting units 10(6) and 10(8) using the vapor moving force generation units 13(6) and 13(8), vapor which is generated in the heating process is guided to the vapor intake ports 9(6) and 9(8), and it is possible to easily collect the vapor in the vapor collecting units 10(6) and 10(8).

In addition, since the vapor liquefying units 11(6) and 11(8) are located on the movement paths F(6) and F(8) of vapor which moves due to the moving force, it is possible to efficiently liquefy collected vapor.

In addition, according to the embodiment, the vapor moving force generation units 13(6) and 13(8) are fans 113(6) and 113(8) which cause a moving state of vapor by generating a suction force in the vapor intake ports 9(6) and 9(8). Moreover, the vapor liquefying units 11(6) and 11(8) are located downstream of the vapor intake ports 9(6) and 9(8), and on the upstream of fans 113(6) and 113(8) on the movement paths F(6) and F(8). Accordingly, it is possible to reduce a risk that vapor condenses at portions of the fans 113(6) and 113(8).

In addition, according to the embodiment, the second collecting unit 8 is located on the rear surface 7 side of the medium for recording P. In addition, the second collecting unit 8 can collect vapor that is generated on the rear surface 7 side (which is the opposite side to the recording face 5 of the medium for recording P) in the vapor collecting unit 10(8) by having the communication hole 15 as the vapor intake port 9(8) in a state in which the medium for recording P is supported by the support member 14 from below.

In addition, according to the embodiment, the first collecting unit 6 is located on the recording face 5 side of the medium for recording P. In addition, the first collecting unit 6 can effectively collect vapor which is generated on the recording face 5 side of the medium for recording P in the vapor collecting unit 10(6) from the vapor intake port 9(6) which is provided at a position at which the vapor rises.

In addition, according to the embodiment, the first heating unit 3 includes the electromagnetic wave irradiation unit 12 which dries liquid using electromagnetic waves.

Accordingly, since ink ejected onto the medium for recording P is dried using electromagnetic waves (such as infrared light), a structure of a portion at which the heating process is performed does not become complicated.

In addition, according to the embodiment, it is possible to use cloth as the medium for recording P. In the cloth, vapor easily passes through to the opposite side of the recording face 5. The invention is particularly effective in a liquid ejecting apparatus in which such a medium for recording P can be used.

Second Embodiment

FIG. 4

Hereinafter, an ink jet printing apparatus according to a second embodiment of the invention will be described with reference to FIG. 4.

In the ink jet ejecting apparatus according to the second embodiment, a medium for recording P in a portion 4 (at which a heating process is performed with respect to ink using a first heating unit 3) is supported by being tilted in a range of 10° or more and 60° or less with respect to an installing surface (usually planar floor face) which is not illustrated, of the ink jet printing apparatus.

According to the second embodiment, a first collecting unit 6 and a second collecting unit 8 have basically the same structure as those in the first embodiment. Since the structure has the same structure as in the first embodiment (except that a support member 14 of the second collecting unit 8 has the tilted structure, and that a design is changed in order to match the tilted structure), the same constituent elements are given the same reference numerals, and descriptions thereof will be omitted.

Vapor that is generated due to a heating process from the medium for recording P which is in a tilted state becomes an ascending air current which rises vertically. Accordingly, an area of a horizontal section in a region of the ascending air current becomes small (with respect to an area of the portion 4 at which the heating process is performed using heating). Accordingly, it is possible to make a size of a vapor intake port 9(6) (which is included in the first collecting unit 6) small with respect to a horizontal support structure in which the tilting is not performed. In this manner, it is possible to perform miniaturization.

In the second embodiment, a third collecting unit 23 with respect to vapor that is generated from a region 24 in which ink is ejected from a recording head 1 is further included. The third collecting unit 23 includes a vapor collecting unit 10(23) which collects vapor, and a vapor liquefying unit which liquefies the collected vapor.

The recording head 1 is a serial type which performs recording by reciprocating in the main scanning direction B that intersects the transport direction A of the medium for recording P. However, the recording head may be a so-called line head in which a plurality of ink-ejection nozzles are provided in a direction intersecting the transport direction A.

Here, in the "line head", the region of nozzles (which are formed in the direction intersecting the transport direction A of the medium for recording P) is provided so as to include the entire intersecting direction of the medium for recording P. The line head is used in a recording apparatus which forms an image by fixing one of a recording head and a medium for recording, and by moving the other. In addition, the region of nozzles in the intersecting direction of the line head may not include the entire medium for recording P in the intersecting direction to which the recording apparatus corresponds. In addition, both the recording head and the medium for recording may be moved without fixing one of them.

According to the embodiment, the vapor collecting unit 10(23) is configured of a region 24 towards which ink is ejected from the recording head 1, the recording head 1, and a surrounding body 26 which surrounds a third heating unit 25 which heats the region 24. In addition, the surrounding body 26 does not have a structure of which the inside is completely sealed. For example, the surrounding body includes an opening (vapor intake port and outlet) for causing the medium for recording P to pass through. That is, the structure means a surrounding structure in which it is possible to collect vapor generated from the region 24 with almost no leaking to the outside.

Since a part of volatile components of ink that is ejected onto the medium for recording P is evaporated in the region 24, the third heating unit 25 is configured of an electromagnetic wave irradiation-type heater which radiates electromagnetic waves (such as infrared light) which can heat the region 24 up to approximately 50° C. to 60° C.

In addition, the ink jet printing apparatus according to the second embodiment has a structure in which vapor that is collected in the vapor collecting unit 10(23) of the third collecting unit 23 is sent to the first collecting unit 6. That is, it is a structure in which the liquefying unit 11(6) of the first collecting unit 6 also takes a role of a vapor liquefying unit of the third collecting unit 23.

In this manner, it is not necessary to provide an exclusive vapor liquefying unit for the third collecting unit 23, and for this reason, it is possible to execute a reduction in number of components and miniaturization.

In addition, there may be a structure in which an exclusive vapor liquefying unit for the third collecting unit 23 is provided.

Figure 4:
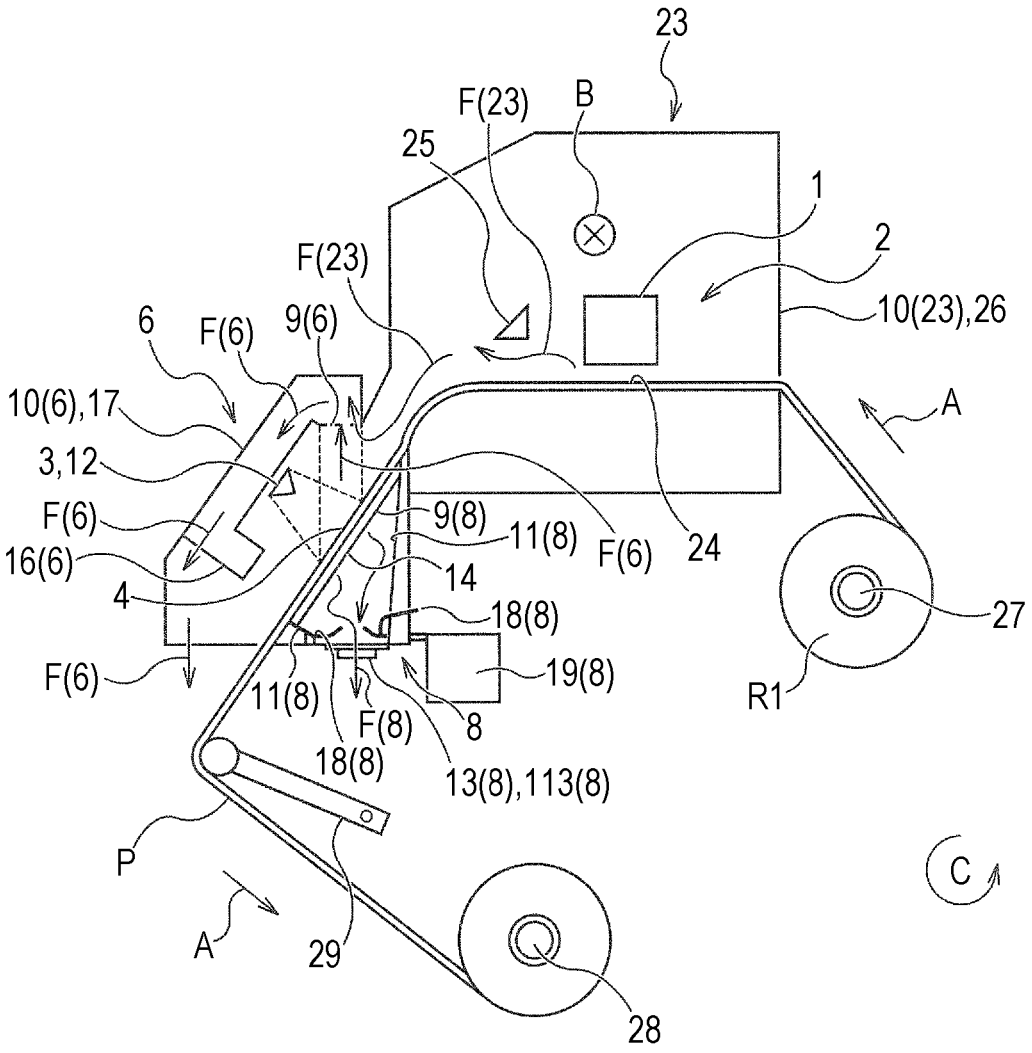
FIG. 4 is a schematic cross-sectional side view which illustrates a liquid ejecting apparatus according to a second embodiment of the invention.

In FIG. 4, a reference numeral F(23) denotes a movement path of vapor that is generated from the region 24 in which ink is ejected from the recording head 1. A moving force of vapor on the movement path F(23) of the vapor is based on a suction force of the fan 113(6) of the first collecting unit 6.

In the second embodiment, since the third collecting unit 23 collects and liquefies vapor that is generated from the region 24 in which ink is ejected from the recording head 1, it is possible to further effectively reduce releasing of vapor into a surrounding environment.

The ink jet printing apparatus according to the second embodiment includes a setting unit 27 which sets a roll R1 which can transport the medium for recording P for recording. In addition, the recording apparatus according to the embodiment uses a roll-type medium for recording as the medium for recording P. However, it is not limited to a recording apparatus which uses such a roll-type medium for recording. For example, the medium for recording may be a medium of a single sheet type.

In the recording apparatus according to the embodiment, the setting unit 27 rotates in the rotation direction C when the medium for recording P is transported in the transport direction A.

In addition, the recording apparatus according to the second embodiment includes a transport mechanism which includes a plurality of transport rollers (not illustrated) for transporting the roll-type medium for recording P in the transport direction A. The medium for recording P is transported in the transport direction A when the setting unit 27 rotates in the rotation direction C, when the plurality of transport rollers (not illustrated) of the transport mechanism 15 rotate, and when the winding unit 28 rotates in the rotation direction C. A movement path of the medium for recording P when being transported is a transport path of the medium for recording P. In FIG. 4, a reference numeral 29 is a tension adjusting unit of the medium for recording P which is transported.

Third Embodiment

Figure 5:
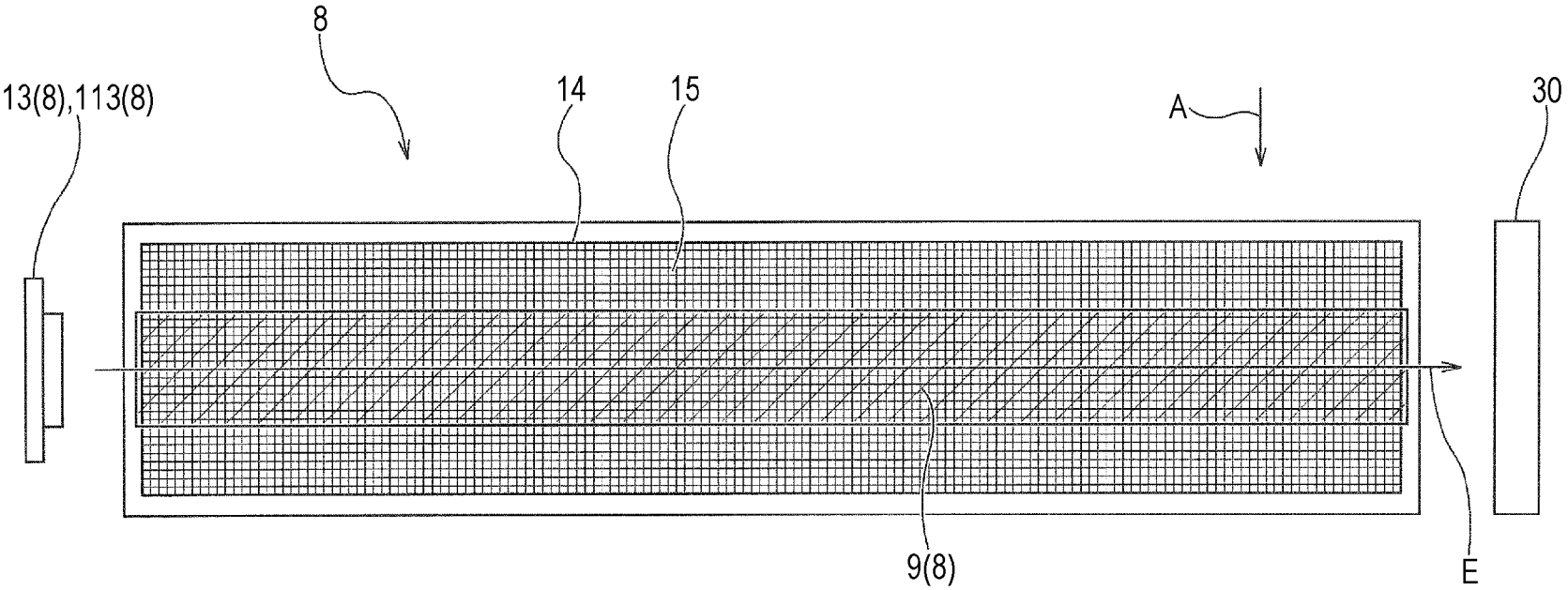
FIG. 5 is a schematic plan view which illustrates a vapor moving force generation unit in a liquid ejecting apparatus according to a third embodiment of the invention.
Figure 6:
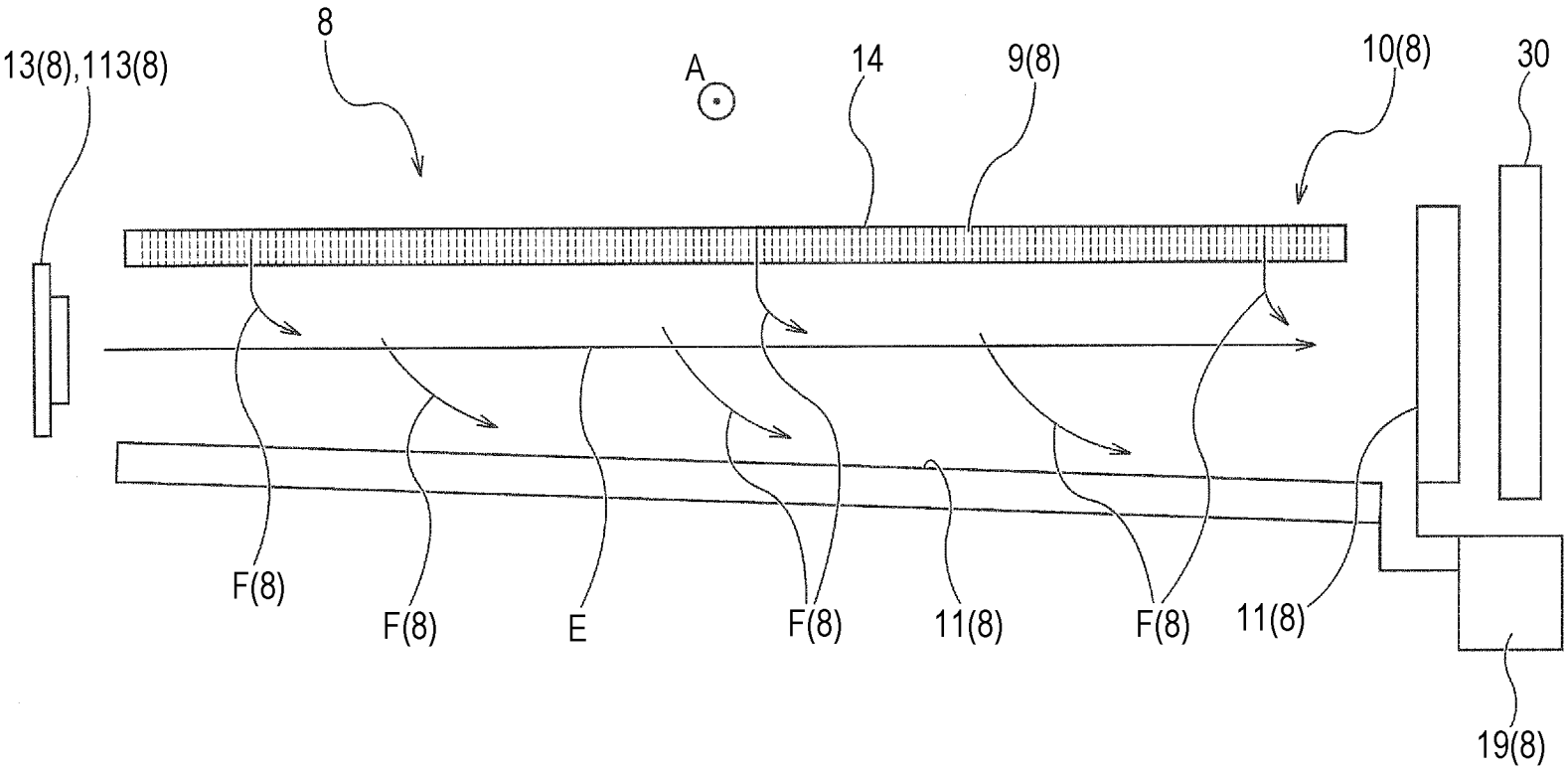
FIG. 6 is a schematic cross-sectional side view which illustrates the vapor moving force generation unit in the liquid ejecting apparatus according to the third embodiment of the invention.

FIGS. 5 and 6

Hereinafter, an ink jet printing apparatus according to a third embodiment of the invention will be described with reference to FIGS. 5 and 6.

A second collecting unit 8 of the ink jet printing apparatus according to the third embodiment is configured as follows. That is, a vapor moving force generation unit 13(8) is a fan 113(8) which causes vapor to move by generating a suction force in a vapor intake port 9(8) using an air current E by being provided at a position different from a movement path F(8) of vapor (that is, on the outer side on the upstream of the movement path F(8)), and the liquefying unit 11(8) is located on the downstream of the fan 113(8) in the direction of the air current E which is generated by the fan 113(8), and on the downstream of the vapor intake port 9(8) on the movement path F(8) of vapor.

The second collecting units 8 in the first embodiment and the second embodiment have structures in which the fan 113(8) as the vapor moving force generation unit 13(8) is located on the downstream side on the movement path F(8), and a suction force thereof can be directly used.

On the other hand, in the second collecting unit 8 according to the embodiment, the air current E is generated in a direction which intersects the transport direction A, and is approximately parallel to a face of a support member 14 using the fan 113(8). In addition, the second collecting unit has a configuration in which vapor is caused to flow due to the air current E from a direction in which the medium for recording P is supported by the support member 14 to a direction facing the opposite side to the side on which the medium for recording P is supported by the support member 14 through the communication hole 15. In addition, it is preferable to add a structure for preventing backflow in order not to make the air current E flow to the side on which the medium for recording P is supported by flowing in the communication hole 15 backward, for example, by using an idea of tilting a direction of the communication hole 15 in a direction of not flowing backward, or the like.

The vapor moves toward the side opposite to the side on which the medium for recording P is supported by the support member 14 from the side on which the medium for recording P is supported by the support member 14 through the communication hole 15 using the air current E, comes into contact with the vapor liquefying unit 11(8) by flowing on the movement path F(8) of vapor, and is liquefied thereafter. In addition, the liquefied liquid flows down to the waste liquid reservoir 30 by flowing along the surface of the vapor liquefying unit 11(8).

In addition, according to the embodiment, a filter 29 is provided to which vapor which cannot be liquefied in the vapor liquefying unit 11(8) drops. However, it is not limited to such a configuration.

According to the third embodiment, it is possible to cause a moving state of vapor by generating a suction force in the vapor intake port 9(8), even using a structure in which the fan 113(8) which forms the vapor moving force generation unit 13(8) is provided at a position which is different from the movement path F(8) of vapor. In addition, even using the structure, it is possible to reduce a risk that vapor condenses at a portion of the fans 113(8).

Fourth Embodiment

Figure 7:
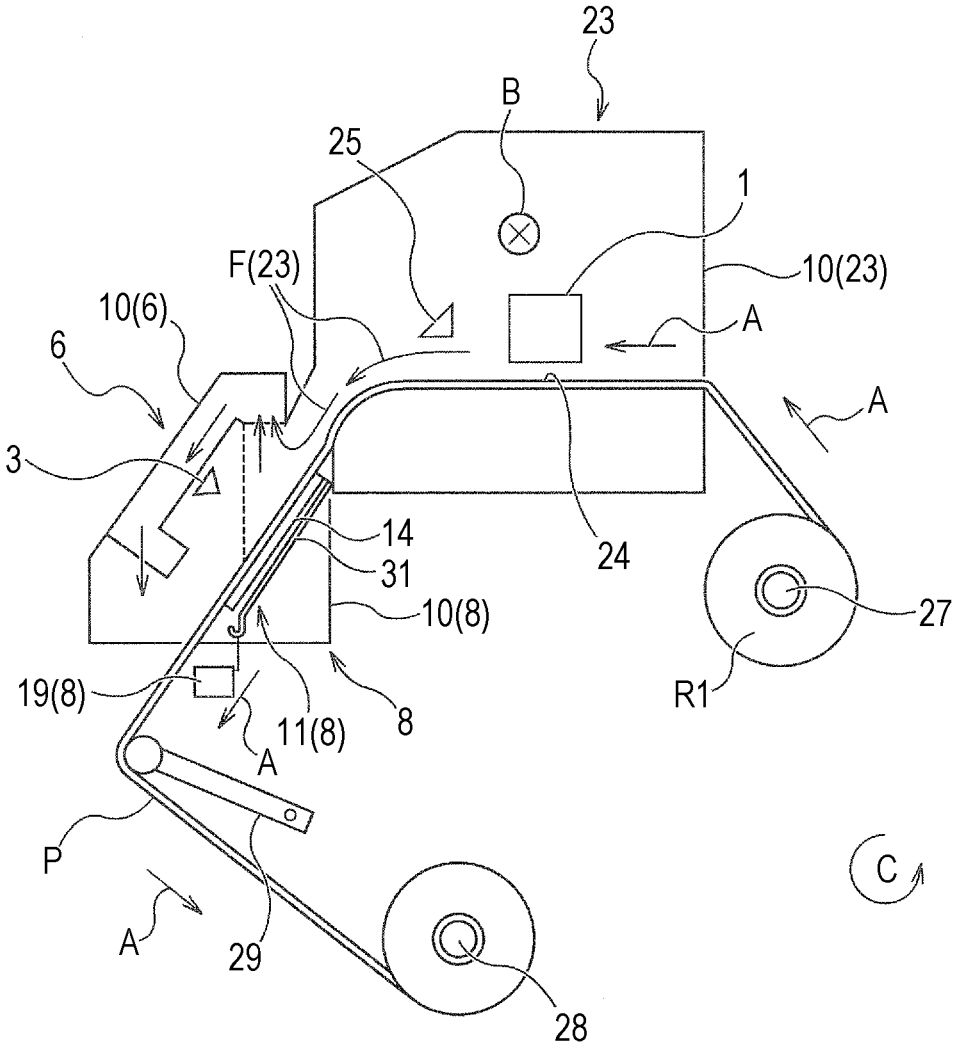
FIG. 7 is a schematic cross-sectional side view which illustrates a liquid ejecting apparatus according to a fourth embodiment of the invention.
Figure 8:
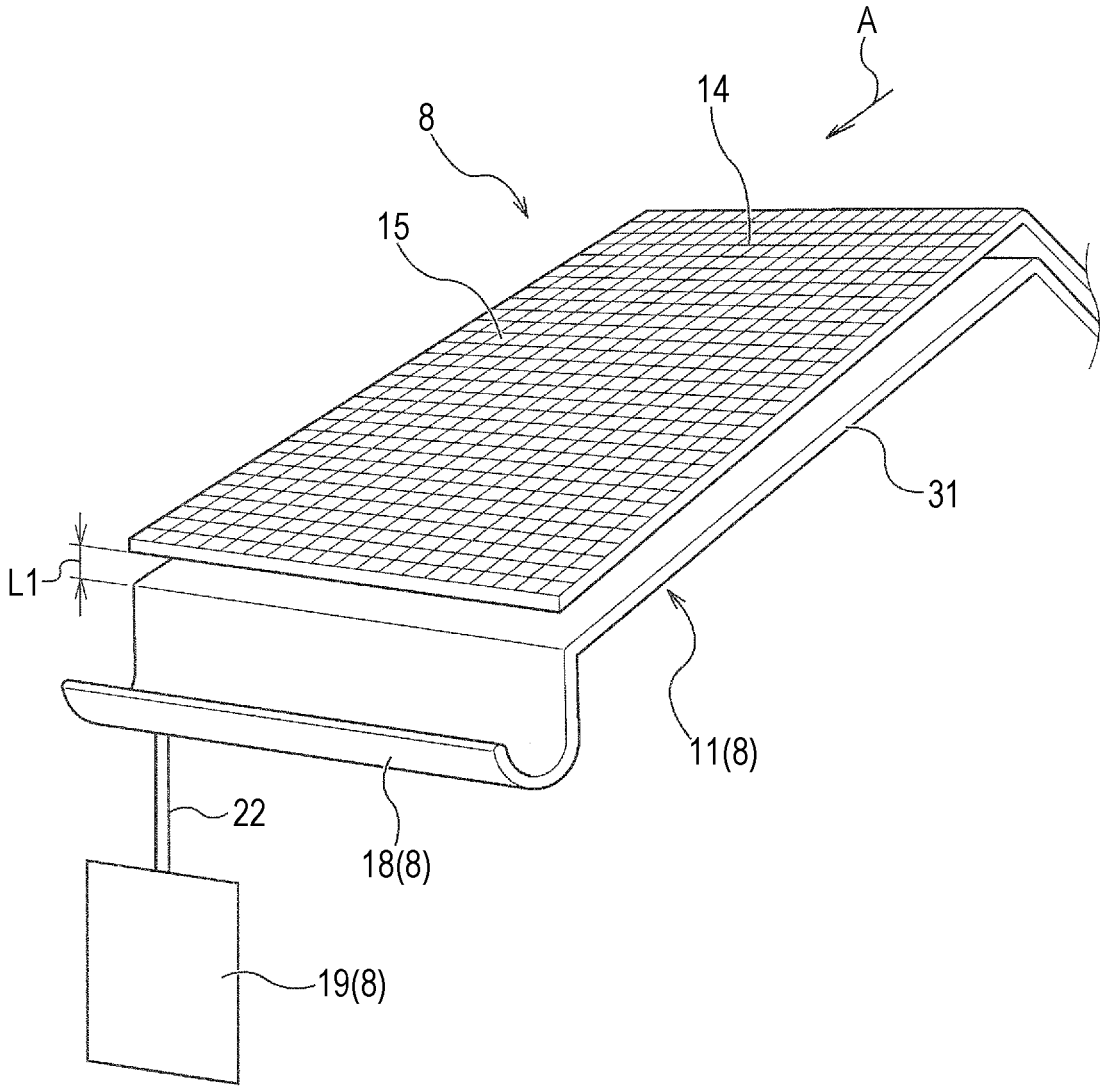
FIG. 8 is a schematic perspective view which illustrates a part of a second collecting unit in a liquid ejecting apparatus according to the fourth embodiment of the invention.

FIGS. 7 and 8

Hereinafter, an ink jet printing apparatus according to a fourth embodiment of the invention will be described with reference to FIGS. 7 and 8.

A second collecting unit 8 of the ink jet printing apparatus according to the fourth embodiment is configured as follows.

That is, the second collecting unit 8 according to the fourth embodiment includes a support member 14 which is located at a position lower than a first collecting unit 6. The support member 14 supports from below the medium for recording P which is transported, and supports a vapor moving force generation unit 13(8) which generates a moving force for moving vapor inside a vapor collecting unit 10(8) in a vapor intake port 9(8).

In addition, the vapor intake port 9(8) is a communication hole 15 which allows communication between the upper face and the lower face, which is provided in the support member 14. The vapor liquefying unit 11(8) is configured of a material 31 with higher thermal conductivity than the support member 14. Furthermore, the moving force of the vapor using the vapor moving force generation unit 13(8) is generated when the vapor easily condenses on the vapor liquefying unit 11(8) side at which thermal conductivity is higher than the support member 14.

According to the fourth embodiment, the support member 14 and the vapor liquefying unit 11(8) are arranged with a gap L1 therebetween. It is preferable that the gap L1 be 2 mm or more and 20 mm or less. In addition, the vapor liquefying unit 11(8) is formed of an aluminum material, and the support member 14 is formed of a stainless steel material. As a matter of course, there is no limitation to the combination.

According to the fourth embodiment, it is possible to generate a moving force of vapor in the vapor intake port 9(8) using a difference in thermal conductivity between the support member 14 and the vapor liquefying unit 11(8) without using the vapor moving force generation unit 13(8) as a fan as in the previous embodiment. It is also possible to collect vapor similarly to the previous embodiment using this structure.

Fifth Embodiment

FIG. 9

Figure 9:
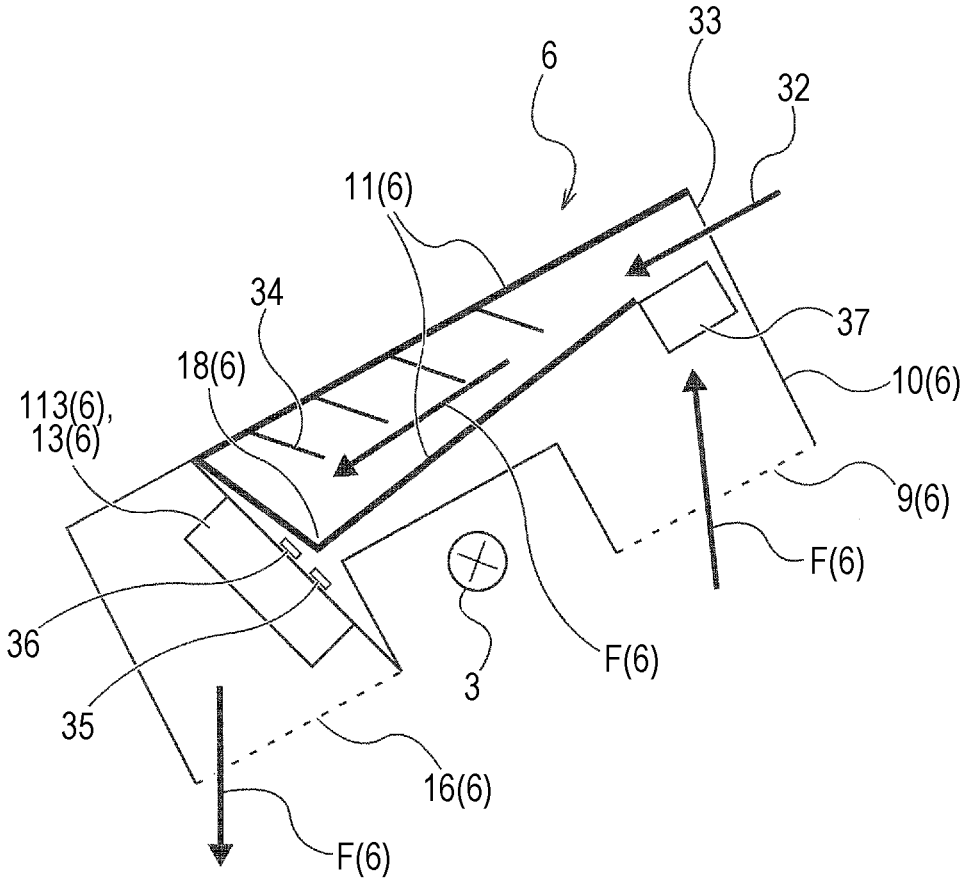
FIG. 9 is a schematic cross-sectional side view which illustrates a first collecting unit in a liquid ejecting apparatus according to a fifth embodiment of the invention.

Hereinafter, an ink jet printing apparatus according to a fifth embodiment will be described with reference to FIG. 9.

A first collecting unit 6 of the ink jet printing apparatus according to the fifth embodiment is configured as follows.

In the first collecting unit 6 according to the fifth embodiment, a communication hole 33 (which can take ambient air 32 into a vapor collecting unit 10(6)) is provided at the vapor collecting unit 10(6). In addition, an expansion of a contact area with vapor is planned by providing a fin 34 at a vapor liquefying unit 11(6). A reference numeral 37 in FIG. 9 is an auxiliary fan.

In this manner, since the first collecting unit 6 can take ambient air into the vapor collecting unit 10(6), it is possible to simply adjust a temperature of the vapor liquefying unit 11(6) by adjusting an amount of ambient air which is taken in.

In addition, according to the fifth embodiment, the first collecting unit 6 includes a concentration sensor 35 which measures an amount of vapor in air after the liquefaction of vapor on the upstream of a position of the fan 113(6). As a matter of course, specifically, there are a zirconia type high temperature humidity analyzer, a long wavelength InGaAs photodiode, an infrared LED, and the like, as the concentration sensor 35. As a matter of course, the concentration sensor 35 may be provided in the second collecting unit 8.

In this manner, it is possible to secure a state in which vapor or an organic solvent is hardly present in air by setting a temperature of the vapor liquefying unit 11(6) using a measurement result of the concentration sensor 35.

In addition, according to the fifth embodiment, the first collecting unit 6 further includes a pressure sensor 36 which measures a vapor pressure on the upstream of a position of the fan 113(6) in the vapor liquefying unit 11(6). As the pressure sensor 36, specifically, there are a crystal pressure sensor, a MEMS pressure sensor, and the like. As a matter of course, the pressure sensor 36 may be provided in the second collecting unit 8.

In this manner, it is possible to easily realize a state in which vapor or an organic solvent is hardly present in air by setting a temperature of the vapor liquefying unit 11(6) using a measurement result of the pressure sensor 36.

Sixth Embodiment

FIG. 10

Figure 10:
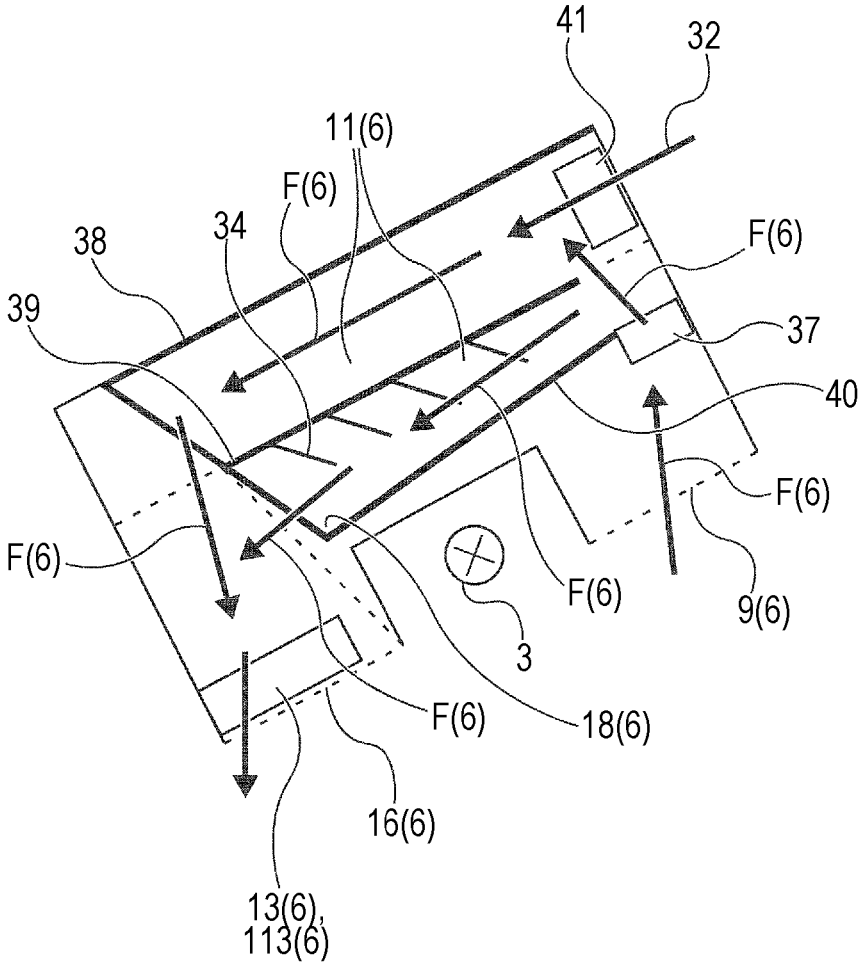
FIG. 10 is a schematic cross-sectional side view which illustrates a first collecting unit in a liquid ejecting apparatus according to a sixth embodiment of the invention.

Hereinafter, an ink jet printing apparatus according to a sixth embodiment of the invention will be described with reference to FIG. 10.

A first collecting unit 6 of the ink jet printing apparatus according to the sixth embodiment is configured as follows.

The first collecting unit 6 according to the sixth embodiment has a configuration in which a plurality of layers of vapor liquefying unit 11(6) are provided, and each layer has a different liquefying temperature. For example, a first layer 38 is set to a temperature of 30° C., a second layer 39 is set to a temperature of 50° C., and a third layer 40 is set to a temperature of 70° C. In FIG. 10, a reference numeral 41 is a fan for taking in ambient air.

According to the sixth embodiment, in the first collecting unit 6, the vapor liquefying unit 11(6) is configured of a layered structure having a plurality of layers, and since each layer has a different liquefying temperature, it is possible to improve a liquefying efficiency of vapor using the multilayered structure.

What is claimed is:

1. A liquid ejecting apparatus comprising:

a liquid ejecting unit which ejects liquid onto a first face of a medium for recording which has the first face and a second face which is a rear face of the first face;

a first heating unit which heats the liquid ejected onto the first face of the medium for recording;

a first collecting unit which is provided at a position facing the first face of the medium for recording; and a second collecting unit which is provided at a position facing the second face of the medium for recording, wherein the first collecting unit includes:

a first vapor collecting unit disposed above a medium path which collects vapor which is generated in a heating process of the liquid using the first heating unit, and a first vapor liquefying unit disposed above the medium path which liquefies the collected vapor;

wherein the second collecting unit includes:

a second vapor collecting unit disposed below the medium path which collects vapor which is generated in the heating process of the liquid using the first heating unit, and a second vapor liquefying unit disposed below the medium path which liquefies the collected vapor.

2. The liquid ejecting apparatus according to claim 1, wherein the first collecting unit includes:

a first vapor intake port for taking vapor in, and a first vapor moving force generation unit which generates a force for moving vapor into the first vapor collecting unit through the first vapor intake port, and wherein the first vapor liquefying unit is located on a first movement path of vapor which moves due to the moving force generated by the first vapor moving force generation unit;

wherein the second collecting unit includes:

a second vapor intake port for taking vapor in, and a second vapor moving force generation unit which generates a force for moving vapor into the second vapor collecting unit through the second vapor intake port, and wherein the second vapor liquefying unit is located on a second movement path of vapor which moves due to the moving force generated by the second vapor moving force generation unit.

3. The liquid ejecting apparatus according to claim 2, wherein the first vapor moving force generation unit includes a first fan which generates a suction force in the first vapor intake port, and causes a moving state of vapor, and wherein the first vapor liquefying unit is located on a downstream side of the first vapor intake port, and on an upstream side of the first fan on the first movement path of the vapor.

4. The liquid ejecting apparatus according to claim 3, wherein the first vapor moving force generation unit is provided at a position different from the first movement path of the vapor, wherein the first vapor moving force generation unit is a first fan which causes a moving state of vapor by generating a suction force in the first vapor intake port using an air current, and wherein the first vapor liquefying unit is located on a downstream side of the first fan in a direction of an air current which is generated by the first fan, and on a downstream side of the first vapor intake port on first movement path of the vapor.

5. The liquid ejecting apparatus according to claim 1, further comprising:

a support member which supports the medium for recording; and a second vapor moving force generation unit which generates a moving force for moving vapor into the second vapor collecting unit through a second vapor intake port, wherein the second vapor intake port of the second collecting unit includes a communication hole provided in the support member which allows communication between an upper face and a lower face of the support member, wherein the second vapor liquefying unit is configured of a material with higher thermal conductivity than that of the support member, and wherein a moving force of the vapor using the second vapor moving force generation unit is generated when the vapor is condensed on a side of the second vapor liquefying unit at which a thermal conductivity is higher than that of the support member.

* * * * *